US005237927A

United States Patent [19]

Gonzalez et al.

[11] Patent Number: 5,237,927

[45] Date of Patent: Aug. 24, 1993

[54] ENERGETIC CONSUMABLE CARTRIDGE CASE

[75] Inventors: Antonio F. Gonzalez; William L. O'Meara, both of Tallahassee, Fla.

[73] Assignee: Olin Corporation, Cheshire, Conn.

[21] Appl. No.: 779,661

[22] Filed: Oct. 21, 1991

[51] Int. Cl.[5] ..... F42B 5/192

[52] U.S. Cl. ..... 102/431; 102/465; 102/700

[58] Field of Search ..... 102/431, 433, 466, 700, 102/331, 464; 149/97, 98

[56] References Cited

U.S. PATENT DOCUMENTS

| | | | |
|---|---|---|---|
| 895,558 | 8/1901 | Harris | 102/431 |
| 3,397,637 | 8/1968 | Bobinski et al. | 102/431 |
| 3,670,649 | 6/1972 | Hartlein et al. | 102/431 |
| 3,703,868 | 11/1972 | Braak . | |
| 3,706,280 | 12/1972 | Bobinski et al. | 102/431 |
| 3,727,512 | 4/1973 | Berger | 102/431 |
| 3,730,094 | 5/1973 | Quinian | 102/431 |
| 3,769,873 | 11/1973 | Abel | 102/431 |
| 3,770,563 | 11/1973 | Bobinski et al. | 102/431 |
| 3,877,374 | 4/1975 | Cook | 102/431 |
| 3,927,616 | 12/1975 | Axelrod et al. | 102/431 |
| 3,987,731 | 10/1976 | Brzuskiewicz | 102/431 |
| 4,363,273 | 12/1982 | Luebben et al. | 102/431 |
| 4,365,558 | 12/1982 | Lippler et al. | 102/431 |
| 4,581,998 | 4/1986 | Horst, Jr. et al. | 102/289 |
| 4,649,827 | 5/1987 | Brasquies et al. | 102/431 |
| 4,709,636 | 12/1987 | Mueller et al. | 102/431 |

FOREIGN PATENT DOCUMENTS

| | | | |
|---|---|---|---|
| 2590013 | 5/1987 | France | 102/431 |

*Primary Examiner*—Harold J. Tudor
*Attorney, Agent, or Firm*—John R. Wahl

[57] ABSTRACT

An energetic combustible cartridge case comprises a tubular body of a plastic nonfelted sheet propellant and an outer coating portion of a thermoset polymeric resin such as a polyurethane. The sheet propellant is a colloidal nitrocellulose composition which preferably contains a large portion of nitroglycerine and diethylene glycol dinitrate.

4 Claims, 1 Drawing Sheet

ENERGETIC CONSUMABLE CARTRIDGE CASE

FIELD OF THE INVENTION

This invention relates generally to cartridges and more particularly to combustible cartridge cases adapted to contain a propellant charge and support a projectile.

BACKGROUND OF THE INVENTION

Combustible containers for propellant compositions in commercial use at the present time typically are fabricated by a felting process utilizing paper or cardboard materials. An illustrative container material is Kraft paper employing 13.4 percent nitrogen containing nitrocellulose, and the paper can be coated, impregnated or dipped to incorporate various optional additives as desired.

Among the disadvantages of the prior art combustible containers is the tendency to leave a burn residue in the combustion chamber of the gun, and the tendency to absorb moisture during long term storage. Accordingly, new containers which are clean burning during use and are moisture resistant are highly desired by the ammunition manufacturing community.

Conventional combustible cases are constructed by a felting process or spiral wrapping nitrocellulose impregnated Kraft paper on a mandrel and then soaking the case so formed in a solution such as a polyurethane and solvent. The polyurethane and solvent is distributed through the tubular body of the case. This soak yields a concentration gradient of polyurethane across the wall thickness of the tubular case. Conversely, the polyurethane resin may be premixed with the felting nitrocellulose and kraft fibers, eliminating the polyurethane soaking step. In addition, the voids left during the drying process prevents a perfect moisture seal. Thus the conventional case so constructed is not completely moistureproof.

In addition, the conventional case contributes minimal energy into the propulsion system. The propellant charge carried within the case in conventional combustible cartridge cases must have sufficient energy to generate the bulk of the propelling gases as well as incinerate the casing in order to leave no residue within the gun chamber.

Separately applied coatings help to provide a moisture seal. However, to provide this seal, the coating must be nonporous, which tends to inhibit complete combustion of the case. Accordingly, an energetic material can be incorporated into this coating.

One energetic protective coating for a caseless propellant charge is disclosed in U.S. Pat. No. 3,730,094. In this case a liquid mixture is applied to the exterior of the caseless molded charge. The liquid mixture is an explosive such as HMX or RDX and cellulose acetate in acetone. The mixture is applied to the exterior of the molded propelling charge and then the acetone evaporated. Cellulose acetate is added to improve the high temperature characteristics of the mixture.

Another example of a combustible case coating is found in U.S. Pat. No. 3,927,616. This patent discloses an oil and water resistant coating of RDX dispersed in a polymeric resin such as an alkyl methacrylate polymer.

Another protective coating for a combustible case is disclosed in U.S. Pat. No. 3,987,731. In this patent, the case, made of nitrocellulose (NC), reinforcing fibers and a resin binder is coated first with polyvinyl alcohol resin and then with a copolymer of vinylidine chloride and acrylonitrile. The resultant case is said to be resistant to moisture and oil.

Another example of a protective coating for a caseless propelling charge or combustible casings is disclosed in U.S. Pat. No. 4,363,273 to Luebben et al. This patent discloses a two step composite coating for a porous NC case permeated with a polyurethane which has a first undercoating containing metal particles bonded to the case and an outer coating of a polyurethane resin. This composite coating allegedly makes the cartridge resistant to ignition when exposed to contact with hot surfaces, a very desirable feature. The outer coating provides the moisture seal.

Other patents describing coatings or moisture resistant combustible cases include U.S. Pat. Nos. 3,397,637; 3,670,649; 3,703,868; 3,706,280; 3,727,512; 3,769,873; 3,770,563; 3,877,374; 4,649,827; and 4,709,636.

A new casing for molding directly to a solid molded or compacted propelling charge is disclosed in copending U.S. patent application Ser. No. 07/576,576, filed Aug. 31, 1990, now U.S. Pat. No. 5,069,133, and assigned to the Assignee of the present invention. This copending application is incorporated herein in its entirety by reference. This copending application discloses an encased propellant such as Ball Powder® propellant made by Olin Corporation. The solid self supporting propellant charge is encased in an overwrapping of an elastomeric coating composition free of any cellulosic compound, and preferably comprises a polyurethane. As such, the coating is very thin and is thus completely incinerated during the ballistic cycle. Thus an energetic constituant in the coating is not needed.

In situations where a loose propellant charge, such as Ball Powder® propellant or stick propellant is used, a separate container made of nitrocellulose impregnated Kraft paper is generally used. These containers may be advantageously overwrapped as described in the above patents or as in the above mentioned copending application to provide a moisture proof casing. However, use of such a casing does not significantly contribute to the combustion process within the gun chamber. These cases typically produce about 5% of the total propellant system energy.

Therefore there is still a need for a casing which provides adequate protection from the environment, is totally consumed during the combustion process and at the same time contributes substantial energy to the combustion process.

SUMMARY OF THE INVENTION

The present invention solves the needs mentioned above by providing a structurally self supportive casing made entirely of a plastic, nonfelted sheet propellant providing about twice the energy as conventional combustible cases.

This propellant material is a colloidal nitrocellulose composition containing no cellulosic fibers. It may contain a large portion of energetic material such as nitroglycerine (NG) and diethylene glycol dinitrate (DEGDN). This propellant material is formed as a sheet and then rolled into a tube to form the casing. This casing is then overwrapped with an elastomeric coating composition as described in the copending application mentioned above. The resultant casing for a propellant charge is energetic, i.e. it provides at least 10% of the total energy in the propellant system and is totally consumed during propellant burn and is totally impervious to moisture. In addition, the casing in accordance with the invention is abrasion resistant and reduces the total propellant charge required for a given ballistic result because the casing itself is constructed of a propellant material.

These and other aspects of the invention will become apparent upon reading the following detailed description when taken in conjunction with the accompanying drawing.

DETAILED DESCRIPTION OF THE INVENTION

The combustible case in accordance with the present invention comprises a tubular body 10 having an inner propellant portion 12 and an outer coating portion 14. The inner propellant portion 12 is formed of a strip of sheet propellant such as JA2 which is wrapped in a spiral or helical fashion about a forming mandrel. The outer coating portion 14 is preferably a polyurethane coating made and applied as described in copending U.S. patent application Ser. No. 07/576,576.

The sheet propellant may be any propellant which can be formed into a sheet material. Preferably, JA2 is used. JA2 is about 60–65% nitrocellulose, 15–20% nitroglycerine, and 15–20% diethylene glycol dinitrate (DEGDN). The JA2 sheet is preheated to between about 40°–50° C. and then spiral wound around a cylindrical mandrel. The inner propellant portion 12 is then cooled to room temperature and removed from the mandrel.

Figure 2:
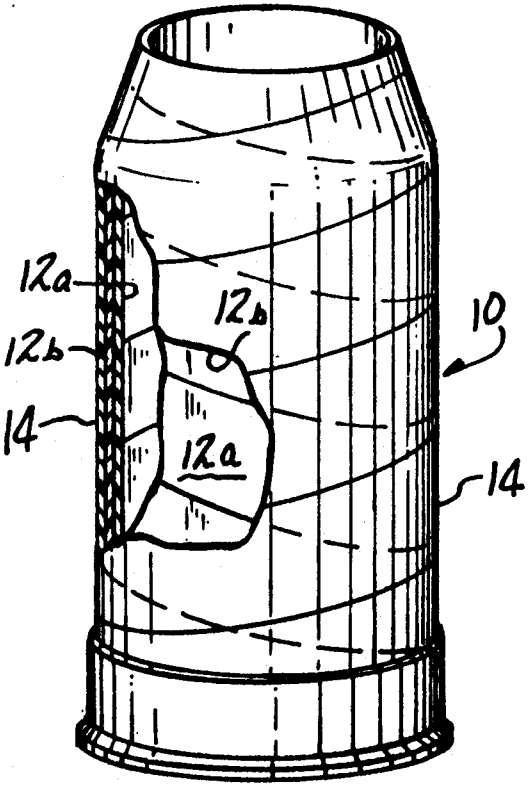
FIG. 2 is a longitudinal sectional view of an alternative embodiment of the combustible case in accordance with the invention.
Figure 1:
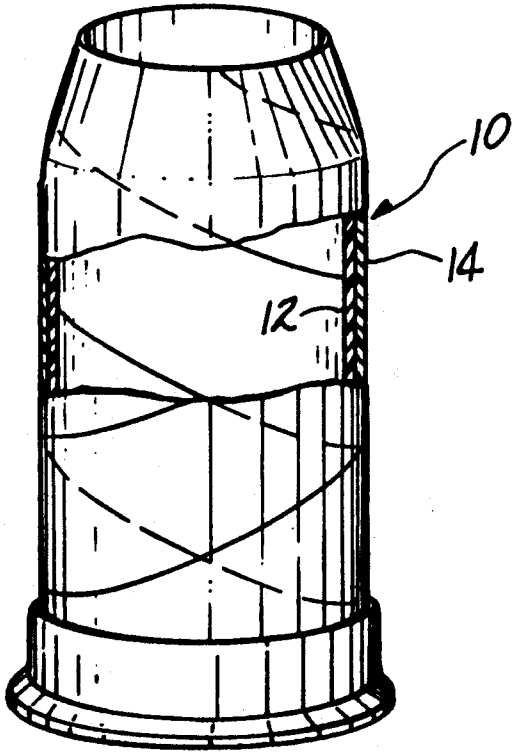
FIG. 1 as a longitudinal partial sectional view of a combustible casing in accordance with the invention.

A single wrap, as shown in FIG. 1, of preferably about 0.10 inch thickness can be used for a 120 mm case. Alternatively, double wraps 12*a* and 12*b* can be used, as is shown in FIG. 2, wound in opposite directions. In the latter case, each wrap 12*a* and 12*b* will be about 0.05 inch thick. Winding the wraps in opposite directions ensures that any gaps in the butt joined sides of the wrap are covered. The total thickness of inner portion 12 can range from 0.01 to 0.1 of the bore diameter of the gun. For a 120 mm gun, the total thickness of the completed case is preferably about 0.125 inches.

The inner portion 12 is then preferably coated with an oxygen balanced polyurethane resin to a thickness of preferably between about 0.01–0.06 inches to form the outer coating portion 14. This outer portion provides a homogeneous layer that is impervious to moisture and forms an abrasion resistant shell which protects the inner propellant portion during storage and handling without having a deleterious effect on the combustion of the propellant of the inner portion. This coating portion 14 can be applied as a spray or may be injection molded onto the inner portion 12.

It is to be understood that the above described embodiments of the invention are illustrative only. Modifications throughout may occur to those skilled in the art. Accordingly, it is intended that the invention is not to be limited to the embodiments disclosed herein but is defined by the scope and fair meaning of the appended claims. All patents, patent applications and other documents specifically referred to above are incorporated herein by reference in their entirety.

What is claimed is:

1. An energetic combustible cartridge case comprising:

a hollow body for containing a propellant charge therein, said body having an inner portion of a plastic, energetic, cellulosic fiber free, colloidal nitrocellulose composition sheet propellant material containing nitroglycerine and diethylene glycol dinitrate and an outer coating portion adhered to the exterior of said inner portion, said coating portion comprising thermoset resin material.

2. The case according to claim 1 wherein said coating portion is free of any cellulosic compound.

3. The case according to claim 2 wherein said coating comprises a polyurethane resin.

4. An energetic combustible cartridge case comprising:

a tubular body for containing a propellant charge therein, said body having an inner portion having at least two overlapping spiral wrapped layers of an energetic plastic cellulosic fiber free, colloidal nitrocellulose composition sheet propellant containing nitroglycerine and diethylene glycol dinitrate and an outer coating portion adhered to the exterior of said inner portion comprising an elastomeric thermoset resin material.

* * * * *